US009212861B2

(12) United States Patent
Panak

(10) Patent No.: US 9,212,861 B2
(45) Date of Patent: Dec. 15, 2015

(54) FEEDBACK-CONTROLLED RE-TARGETING APPARATUS FOR AUTOMATIC FIREARM

(71) Applicant: David Panak, Rockwall, TX (US)

(72) Inventor: David Panak, Rockwall, TX (US)

( * ) Notice: Subject to any disclaimer, the term of this patent is extended or adjusted under 35 U.S.C. 154(b) by 64 days.

(21) Appl. No.: 14/261,863

(22) Filed: Apr. 25, 2014

(65) Prior Publication Data

US 2015/0308777 A1 Oct. 29, 2015

(51) Int. Cl.
*F41A 21/38* (2006.01)
*F41A 21/36* (2006.01)
*F41G 3/00* (2006.01)

(52) U.S. Cl.
CPC . *F41A 21/36* (2013.01); *F41G 3/00* (2013.01); *F41A 21/38* (2013.01)

(58) Field of Classification Search
CPC ..... F41A 21/28; F41A 21/36; F41A 21/38; F41A 13/06; F41A 13/08
USPC ..... 89/1.2, 14.05, 14.1, 14.2, 14.3, 14.4; 42/106, 107, 97, 79, 76.01
See application file for complete search history.

(56) References Cited

U.S. PATENT DOCUMENTS

| | | | | |
|---|---|---|---|---|
| 4,457,206 | A * | 7/1984 | Toulios et al. | 89/14.05 |
| 5,631,437 | A * | 5/1997 | LaVigna et al. | 89/14.3 |
| 6,497,170 | B1 * | 12/2002 | Kathe | 89/14.3 |
| 7,237,353 | B1 * | 7/2007 | Beauchamp et al. | 42/1.14 |
| 8,567,300 | B1 * | 10/2013 | Cler | 89/1.2 |
| 2014/0215876 | A1 * | 8/2014 | Popa-Simil | 42/1.06 |
| 2014/0325885 | A1 * | 11/2014 | Lim et al. | 42/1.06 |

* cited by examiner

*Primary Examiner* — Samir Abdosh
*Assistant Examiner* — John D Cooper
(74) *Attorney, Agent, or Firm* — E. Alan Davis

(57) ABSTRACT

An apparatus having a body that attaches to a barrel of a firearm and a chamber disposed in the body that receives combustion gases from the barrel during a firing sequence of the firearm. Sensors, mounted on the body, capture a measurement of an initial line-of-sight to a target prior to the firing sequence and measure deviation from the initial line-of-sight after capture of the measurement of the initial line-of-sight and during the firing sequence. Ports, in communication with the chamber, are controllable to vary discharge of the combustion gases from the chamber. A feedback control unit receives the measurement of the initial line-of-sight and the deviation from the sensors and controls the ports to vary discharge of the combustion gases from the chamber during the firing sequence to generate forces on the barrel to drive the deviation to a minimum.

20 Claims, 6 Drawing Sheets

FEEDBACK-CONTROLLED RE-TARGETING APPARATUS FOR AUTOMATIC FIREARM

BACKGROUND

When a rifle is fired, it recoils to produce a momentary torque that acts to push the line-of-sight of the rifle off-target. The recoil cannot exactly be compensated by how the rifle is gripped or held. In single-shot operation, the sight picture is typically re-acquired manually for following shots. In automatic firing, any following shots can spread away from the line-of-sight that was acquired for the first shot.

BRIEF SUMMARY

In one aspect the present invention provides an apparatus having a body that attaches to a barrel of a firearm and a chamber disposed in the body that receives combustion gases from the barrel during a firing sequence of the firearm. The apparatus also includes sensors, mounted on the body, that capture a measurement of an initial line-of-sight to a target prior to the firing sequence and that measure deviation from the initial line-of-sight after capture of the measurement of the initial line-of-sight and during the firing sequence. The apparatus also includes ports, in communication with the chamber, wherein the ports are controllable to vary discharge of the combustion gases from the chamber. The apparatus also includes a feedback control unit that receives the measurement of the initial line-of-sight and the deviation from the sensors and controls the ports to vary discharge of the combustion gases from the chamber during the firing sequence to generate forces on the barrel to drive the deviation to a minimum.

In another aspect, the present invention provides a method comprising capturing, by sensors mounted on an apparatus body attached to a barrel of a firearm, a measurement of an initial line-of-sight to a target prior to a firing sequence of the firearm. The method also includes receiving, by a feedback control unit of the apparatus, the measurement of the initial line-of-sight prior to the firing sequence. The method also includes measuring, by the sensors, deviation from the initial line-of-sight after said capturing the measurement of the initial line-of-sight and during the firing sequence. The method also includes receiving, by a chamber disposed in the body, combustion gases from the barrel during the firing sequence. The method also includes receiving, by the feedback control unit, the deviation from the sensors. The method also includes controlling, by the feedback control unit, ports in communication with the chamber to vary discharge of the combustion gases from the chamber during the firing sequence to generate forces on the barrel to drive the deviation to a minimum.

In yet another aspect, the present invention provides a method comprising, for each target of multiple targets, capturing, by sensors mounted on an apparatus body attached to a barrel of a firearm, a measurement of a respective initial line-of-sight to the target prior to a firing sequence of the firearm. The method also includes, for each target of the multiple targets, receiving, by a feedback control unit of the apparatus, from the sensors the measurement of the respective initial line-of-sight to the target prior to the firing sequence. The method also includes, for each target of the multiple targets in a sequential fashion, measuring, by the sensors, deviation from the respective initial line-of-sight to the target during a respective portion of the firing sequence directed to the target. The method also includes receiving, by a chamber disposed in the body, combustion gases from the barrel during the firing sequence. The method also includes for each target of the multiple targets in the sequential fashion, receiving, by the feedback control unit, from the sensors the deviation from the respective initial line-of-sight during the respective portion of the firing sequence. The method also includes, for each target of the multiple targets in the sequential fashion, controlling, by the feedback control unit, ports in communication with the chamber to vary discharge of the combustion gases from the chamber during the respective portion of the firing sequence to generate forces on the barrel to drive the deviation from the respective initial line-of-sight to the target to a minimum.

DETAILED DESCRIPTION OF THE EMBODIMENTS

Figure 1:
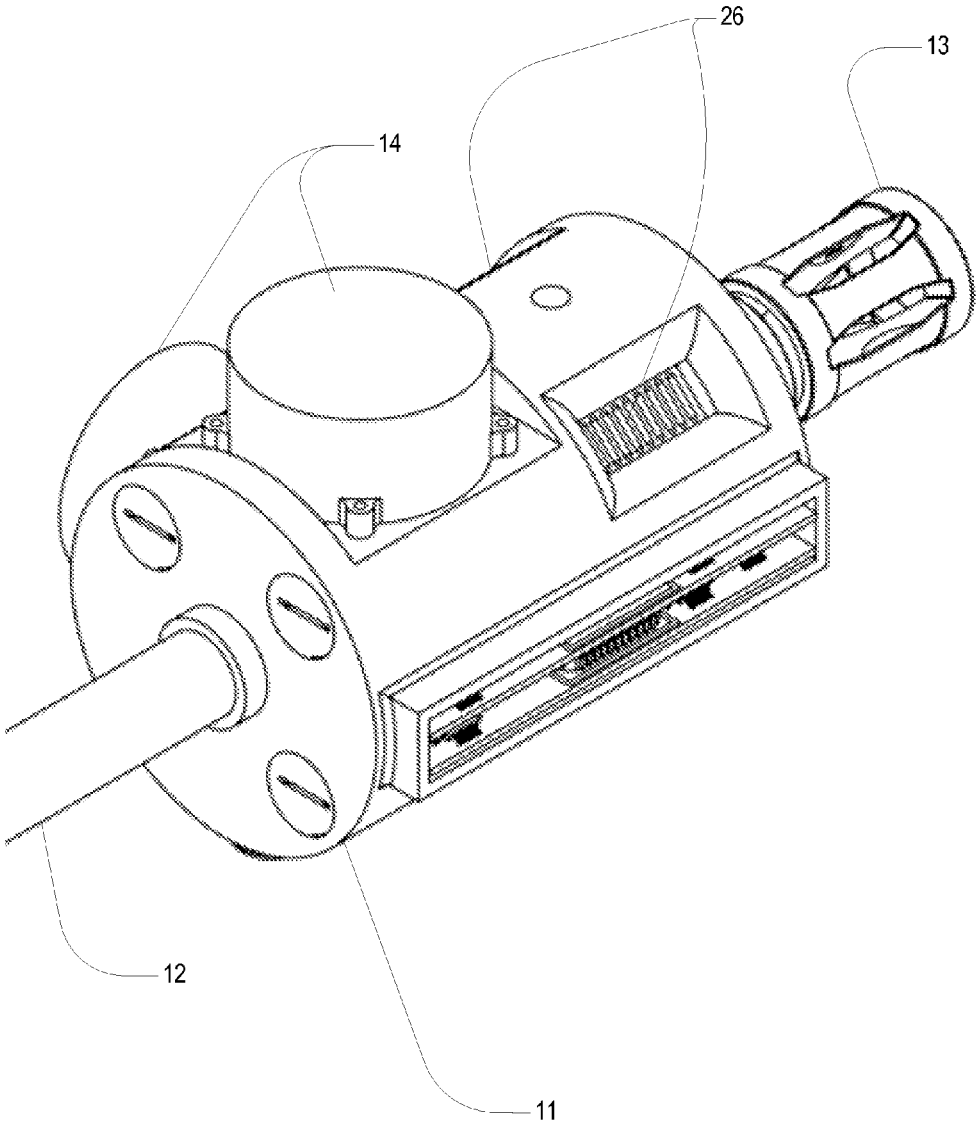
FIG. 1 is a 3-dimensional view illustrating a feedback-controlled re-targeting apparatus attached to the muzzle of a rifle.

Embodiments are described of a feedback-controlled re-targeting apparatus for connecting to the muzzle of an automatic firearm, such as an automatic rifle. When activated, the re-targeting apparatus continuously monitors elevation and azimuth pointing angles of the rifle. The apparatus collects combustion gases exiting the muzzle during a firing sequence of the firearm and controls the discharge of the combustion gases through circumferentially disposed ports of the apparatus. The apparatus detects the pointing angle associated with the rifle barrel prior to the first shot, i.e., the desired line-of-sight, and continuously measures the deviation of the barrel's line-of-sight from the desired line-of-sight throughout the firing sequence. The apparatus rapidly modulates the opening and closing of passages of the individual ports, and thus the volume of discharged combustion gases from the ports, to create a compensating thrust for the torque introduced by grip and the rifle's recoil, which acts to push the rifle's line-of-sight back on target in time for the following shot. Additionally, if the apparatus is actively monitoring the target scene, it may correct for an aiming error in the first shot (to compensate for an error in windage estimation, for example), or re-direct the line-of-site toward a subsequent target in a pre-designated set of two or more targets.

The azimuth and elevation pointing angles of the rifle barrel are monitored in real-time through the use of fiber optic gyros (FOGs), which are angular-rate measurement devices. A commercial FOG is a type of ring laser that utilizes the Sagnac effect to measure angular deviations about the axis of a carrier device, typically a small spool of single-mode optical fiber, to extremely high precision. The apparatus includes two FOG's, mounted orthogonally to each other and to the barrel, which provide high speed angular rate measurements for both azimuth and elevation components of the barrel's line-of-sight.

The apparatus discharges high-speed gas jets through exit ports in a controlled fashion in multiple radial directions arranged circumferentially about the end of the rifle's barrel. By rapidly modulating the flow area and flow direction of the exit ports, the magnitude of the resultant force can be adjusted to compensate for the shift in the barrel's line-of-sight as a round is fired. Piezoelectric-based actuators with the necessary high force and modulation speed are used to control the direction and relative magnitude of the gas jets. Through the use of pulse width modulation (PWM), the piezoelectric actuators essentially vibrate the ports opening and closing action in rapid succession, similar to the action of automotive fuel injectors. By rapidly slewing the pulse width, the proportion of time that a given port is opened relative to when it is closed may be controlled at a high rate. A feedback control loop between the FOGs and the actuators operates at a bandwidth that allows for a large number of relatively minute corrections to the reactive forces between firing events.

The combustion gases exiting the barrel at the muzzle are momentarily captured in an expansion chamber of the apparatus creating pressure therein. As the high-pressure gas exits the expansion chamber through the ports, high-speed actuators begin to modulate the effective opening size of the exit ports. The difference between the measured and desired line-of-sight is calculated by an on-board microprocessor to form an error signal that is continuously driven to a minimum through the operation of the actuators. The resultant unbalance in forces acts against and compensates for the torque that has momentarily forced the barrel's line-of-sight away from the desired path for the following shot. While controlling the relative flow area and direction of the gas jets, the total opening time of each modulating jet is biased against one another, in order to maintain control of the back-pressure in the expansion chamber.

Referring now to FIG. 1, a 3-dimensional view illustrating a feedback-controlled re-targeting apparatus 11 attached to the muzzle of a barrel 12 of a rifle is shown. Preferably, the body of the apparatus 11 is constructed of a lightweight material (e.g., titanium, aluminum, or a carbon fiber composite material) able to withstand the temperatures and forces associated with firearm combustion. The apparatus 11 is attached to the muzzle after an optional flash suppressor 13 is removed from the muzzle and replaced on the end of the apparatus 11 opposite the muzzle. The apparatus 11 has two FOGs 14 attached, one to measure a first axis of rotation, and the other placed orthogonally to the first to measure a second axis of rotation orthogonal to the first. A plurality of ports 26, which are also referred to herein as exit ports or expansion ports, are disposed in the body of the apparatus 11 through which combustion gases exit the apparatus 11 as described herein.

Figure 2:
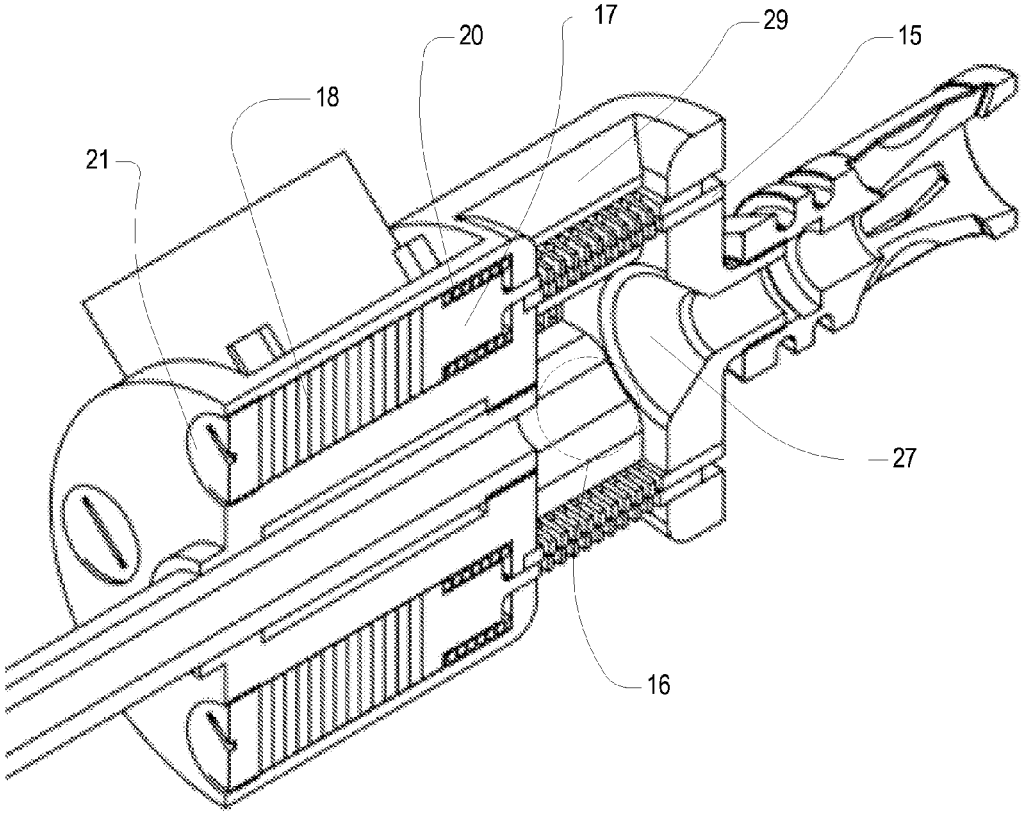
FIGS. 2 through 4 are 3-dimensional cutaway views illustrating elements of the feedback-controlled re-targeting apparatus of FIG. 1.
Figure 3:
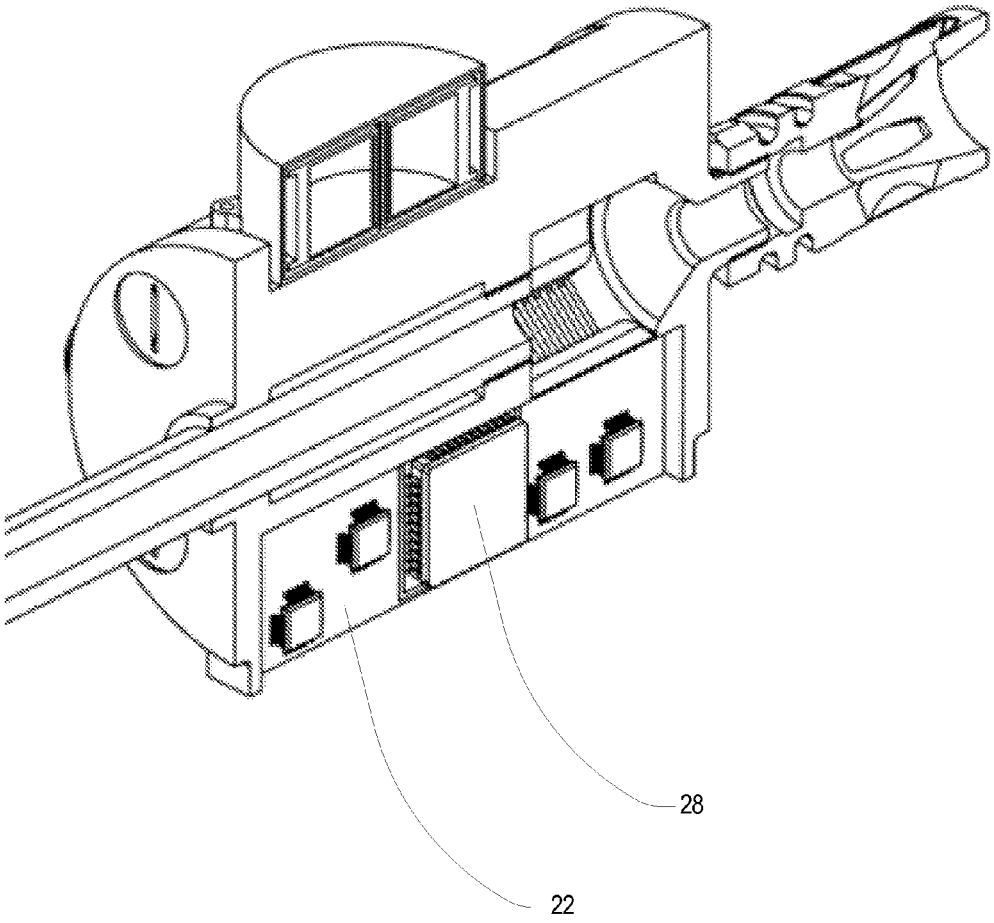
Figure 4:
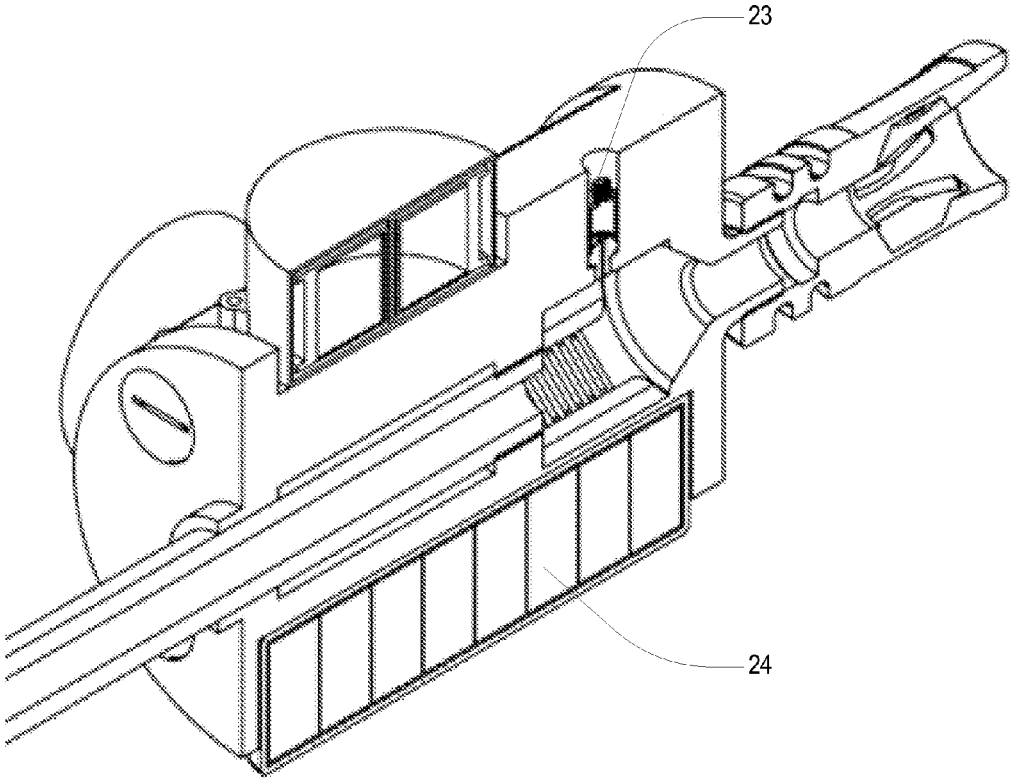

Referring now to FIGS. 2 through 4, 3-dimensional cutaway views illustrating elements of the apparatus 11 of FIG. 1 are shown. The apparatus 11 includes: valve plates 15, an expansion chamber 16, valve pistons 17, piezoelectric stacks 18, expansion nozzles 29, return springs 20, pre-load adjustment caps 21 and a compression nozzle 27 all shown in FIG. 2; an integrated circuit assembly 22 shown in FIG. 3; and a pressure sensor 23 and a rechargeable power pack 24 shown in FIG. 4.

A valve plate 15 is secured in the body of the apparatus 11 at each of the ports 26. The valve plates 15 have a series of slotted openings, or passages, preferably equally spaced, with their interior surfaces facing the expansion chamber 16. The expansion chamber 16 resides between the rifle muzzle and the compression nozzle 27. Fired rounds pass through the muzzle, through the expansion chamber 16 and then through the compression nozzle 27 and exit the apparatus 11. Preferably, the compression nozzle 27 includes threads on its outer circumference for attachment of the optional flash suppressor 13.

Each valve plate 15 is covered with a corresponding moveable valve piston 17. The valve piston 17 has slotted openings that match the openings in the valve plates 15. The valve piston 17 moves axially in a reciprocating motion, with amplitude equal to the width of a slot opening in the valve plate 15. The valve pistons 17 are actuated by piezoelectric stacks 18. Each piezoelectric wafer in the stack 18 provides a small amount of axial deflection when the appropriate drive voltage is placed across the wafer. When all wafers in the piezoelectric stack actuator 18 are likewise energized, the deflections of all the wafers sum together to an amplitude equal to the required stroke of the valve piston 17. The null position (zero voltage) of the stack is the position where each slotted opening in the valve plate 15 is aligned to a corresponding slotted opening in the valve piston 17. With equally spaced slots, all the openings are aligned, which results in the maximum amount of flow passage area through the valve from the expansion chamber 16. At maximum deflection (maximum drive voltage), the slots in the valve plate 15 are completely closed by the valve piston 17, resulting in zero flow area out of the expansion chamber 16. The flow passages are followed by expansion nozzles 29, which provide pressure recovery. As the flow velocity decreases in the expansion nozzle 29, the flow pressure increases, assuming that the flow has not choked at the valve plate 15, and therefore remains subsonic. Each valve piston 17 and piezoelectric stack 18 is constrained between the return spring 20 and the pre-load adjustment cap 21.

The piezoelectric stack actuator 18 voltage drive is periodic, using a PWM scheme. In a PWM drive, the pulse width can be varied in time, independently for each piston 17. As the pulse width is varied for each of the four piezoelectric actuators 18, the ratio of valve open time to valve close time is modulated, such that the expanding gases that follow a firing event may be directed less through one valve, and more through another. The resultant unbalance in pressure forces in the corresponding expansion nozzles 29 generate reactive forces to redirect the barrel 12 of the rifle toward the desired line-of-sight.

The integrated circuit assembly 22, which is an embodiment of a feedback control unit, carries the voltage drive components for each piezoelectric actuator 18, as well as the drive and sensing components for the FOGs 14 and for the pressure sensor 23 mounted to measure the expansion chamber 16 pressure, as shown in FIG. 4. A microprocessor 28 on the integrated circuit 22 performs computations to calculate the required pulse width modulation for a given piezoelectric actuator 18, based on the angular deviation of the barrel 12 that is sensed and measured by each FOG 14 and the available energy for reactive work, which is computed from the chamber pressure sensed by the pressure sensor 23, for a given volume of the expansion chamber 16. Power for the microprocessor 28, valve actuators, pressure sensor 23, and FOGs 14 is provided by the rechargeable power pack 24.

In operation, as the rifle is fired, the combustion gases exit the end of the barrel 12 along with the round. The combustion gases are momentarily collected in the expansion chamber 16 as the fired round continues to travel through the apparatus 11, exiting through the optional flash suppressor 13. As the recoil from the fired round begins to force the line-of-sight associated with the barrel 12 away from the desired line-of-sight, the FOGs 14 detect the angular deviation, and the microprocessor 28 calculates the pulse width scheme to rapidly actuate the piezoelectric stacks 18 to open and close the valve passages. The resulting reactive forces generated by the pressure forces from the expanding gases vented through the expansion ports 26 compensate for the torque applied to the rifle by the recoil, thereby forcing the line-of-sight associated with the barrel 12 toward the desired angle in azimuth and elevation that would be assumed by the following fired round. For example, if the recoil and grip of the rifle produce a torque that forces the barrel 12 of the rifle to rise in elevation as a round is fired, the FOG 14 positioned primarily to measure elevation angles will detect the angular change of the barrel's line-of-sight, and the feedback control unit will force the pulse width drive of the piezoelectric actuators 18 to modulate the topmost valves to be open more often generally than bottommost valve. This tends to cause a larger volume of combustion gases to exit the topmost expansion ports 26 than the bottommost expansion ports 26. The resultant differential pressure acts to force the barrel 12 of the rifle back down and compensate for the recoil torque and redirect the line-of-sight toward the desired line-of-sight. In this way, the pace of the compensating actuation is timed such that the following round may be fired when the line-of-sight associated with the barrel 12 has recovered to the desired angle in elevation. The feedback control unit performs a similar action as needed with respect to the azimuth angle.

Although particular embodiments have been described herein, other embodiments are contemplated. For example, the valve pistons may be arranged in radial or azimuthal direction rather than axial direction. Additionally, the piezoelectric actuators may also operate in push-pull mode, or with dual offsetting actuators, such that a return spring may not be required to perform the reciprocating action of the valve. Furthermore, the actuators may be gas piston operated or electromagnetic rather than piezoelectric. Additionally, the valve passages may have various shapes (e.g., round, square, rectangular, oval) that allow for control of the exiting combustion gas jets through the modulation of the jets caused by the rapid opening and closing of the valves. Also, the valve ports may have additional shaping to improve flow efficiency, flow direction, and/or to improve pressure recovery. Furthermore, the expansion nozzle may have additional shaping and/or fixed ports that aid in gas capture and pressure buildup within the expansion chamber. Still further, multiple valve actuators may be used over each exit port to independently control discharge gas volume and discharge trajectory.

Although embodiments have been described in which FOGs measure the pointing angles, other sensors may be employed such as, but not limited to, ring laser gyros (RLGs), nuclear magnetic resonance gyros (NMRGs), and Micro-Electro-Mechanical Systems (MEMS) gyros.

Also, the apparatus may be controlled by a visual target identification system (e.g., a digital scope) such that the rifle barrel may be forced toward the trajectory of a second desired target in a series of optically pre-designated targets. In this manner, a series of targets may be fired upon automatically and in rapid succession. Furthermore, the apparatus may be controlled by a visual target identification system such that the path of the first round toward the primary designated target is tracked for deflection and windage (pathfinder) such that the second round may be compensated more accurately to follow the desired trajectory to the designated target. Additionally, target designation and identification may be accomplished through the use of an optical designator (such as a targeting laser), where the pointing angle to a selected target is measured by the FOG control system and recorded for the operator whenever the optical designator falls upon a target of interest. In this manner, multiple targets may be recorded and tracked (for example, by an optical recognition system that updates the pointing angle to each target of interest if any of the targets happen to be moving) prior to a firing sequence. The firing sequence may commence in the general direction of the targets of interest, where the first shot for example may not travel toward the first designated target but is used merely by the apparatus to initiate the automatic redirection of the pointing angle of the muzzle toward the first designated target in time for the subsequent shot, and likewise any number of inter-spaced shots may be used by the apparatus to act to redirect the pointing angle of the muzzle toward the next designated target, and so forth. In this way and as a matter of example, a rapid burst of automatic fire of 5 shots within ⅓ of a second may be used in a controlled firing sequence by the apparatus to automatically direct the muzzle of the rifle toward three previously designated and somewhat widely dispersed targets. Additionally, the feedback control unit may control the timing of the firing sequence to delay firing of a next round in the event that the desired line-of-sight is not achieved when the round would be fired according to the normal cycle rate of the firearm.

Additionally, the translation of the muzzle may be measured through the use of accelerometer-type sensors, such as a Micro-Electro-Mechanical Systems (MEMS)-based device, whereby translational errors may be measured between shots and additional compensation applied to the line-of-sight based upon the measured range of the target, which may be acquired through the use of a range finder, such as a laser range finder. The translation measurements from the accelerometer-type sensors are provided to the feedback control unit. The additional compensation is applied to the intended line-of-sight using the angle calculated from translation and range to target such that the point of impact falls on the originally designated target.

Still further, the apparatus may include sensors that measure compass heading and a clock that measures time since the first target was designated in such a manner that any known drift of the FOGs and drift due to earth rotation may be included in the target re-acquisition calculations made by the feedback control unit.

Although embodiments of the apparatus have been described for use with a rifle, other embodiments are contemplated for use with other firearms, such as a pistol. Furthermore, the apparatus may be integral with, or permanently attached to, the firearm. Additionally, although embodiments are described in which the feedback control unit is located proximate with the sensors and the combustion gas ports, other embodiments are contemplated in which the feedback control unit, including the power pack, is located remote from the portion of the apparatus that supports the sensors and port, which may have the benefit of reducing the weight of the portion located on the muzzle. In such an embodiment, the feedback control unit may be located on a more rearward portion of the firearm or carried on a body pack of the operator. In such an embodiment, the feedback control unit may be connected to the sensors via fiber optic cables, wirelines or wirelessly.

Figure 5:
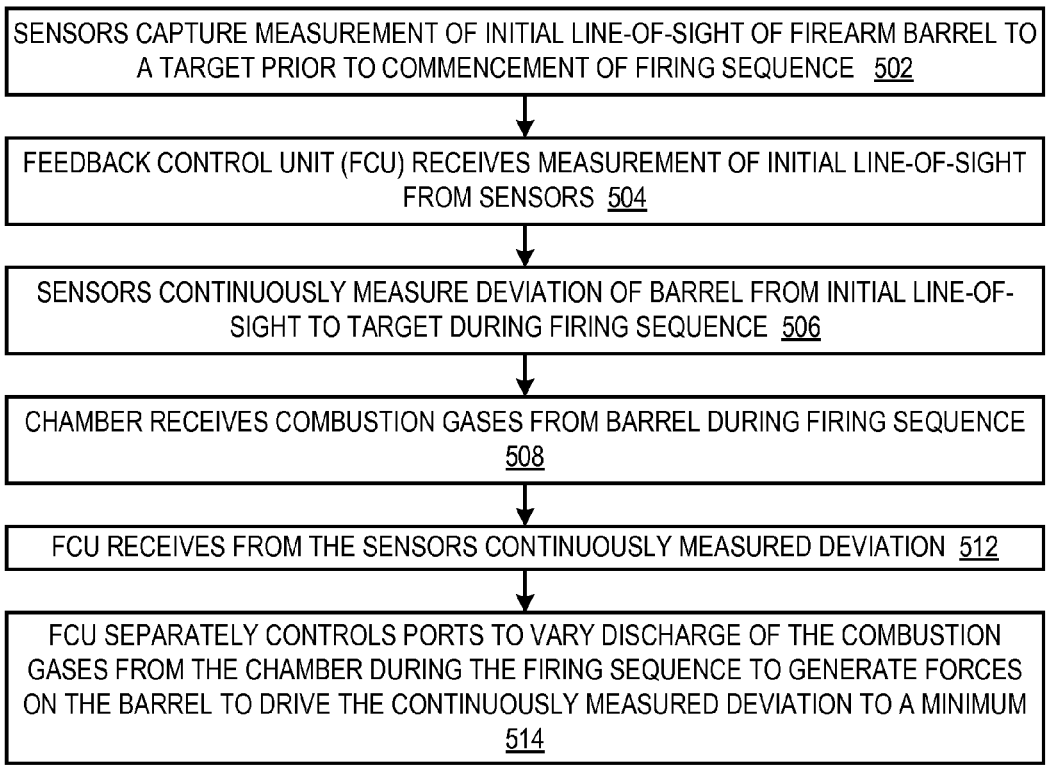
FIGS. 5 and 6 are flowcharts illustrating operation of a feedback-controlled re-targeting apparatus.

Referring now to FIG. 5, a flowchart illustrating operation of a feedback-controlled re-targeting apparatus, such as the apparatus 11 of FIGS. 1-4, is shown. Flow begins at block 502.

At block 502, sensors of the apparatus capture a measurement of an initial line-of-sight of a firearm barrel (e.g., barrel 12 of FIG. 1) to a target prior to commencement of a firing sequence of the firearm. For example, the FOGs 14 capture an initial angular measurement and accelerometers may capture translational measurement (e.g., generated by movement of the firearm as the operator moves the firearm/apparatus to the target line-of-sight). Flow proceeds to block 504.

At block 504, a feedback control unit of the apparatus (e.g., integrated circuit assembly 22) receives the initial target line-of-sight measurement from the sensors. Flow proceeds to block 506.

At block 506, the firing sequence commences, and the sensors continuously measure deviation of the barrel from the initial line-of-sight to the target during the firing sequence. Flow proceeds to block 508.

At block 508, a chamber of the apparatus (e.g., expansion chamber 16) receives combustion gases from the barrel during the firing sequence, which generates pressure in the chamber. Flow proceeds to block 512.

At block 512, during the firing sequence, the feedback control unit receives from the sensors the continuously measured deviation from the initial line-of-sight to the target. Flow proceeds to block 514.

At block 514, during the firing sequence, the feedback control unit separately controls ports of the apparatus (e.g., ports 26) to vary discharge of the combustion gases from the chamber (e.g., by modulating opening and closing of the valve pistons 17 via the piezolelectric actuators 18) to generate forces on the firearm to drive the continuously measured deviation to a minimum. Flow ends at block 514.

Figure 6:
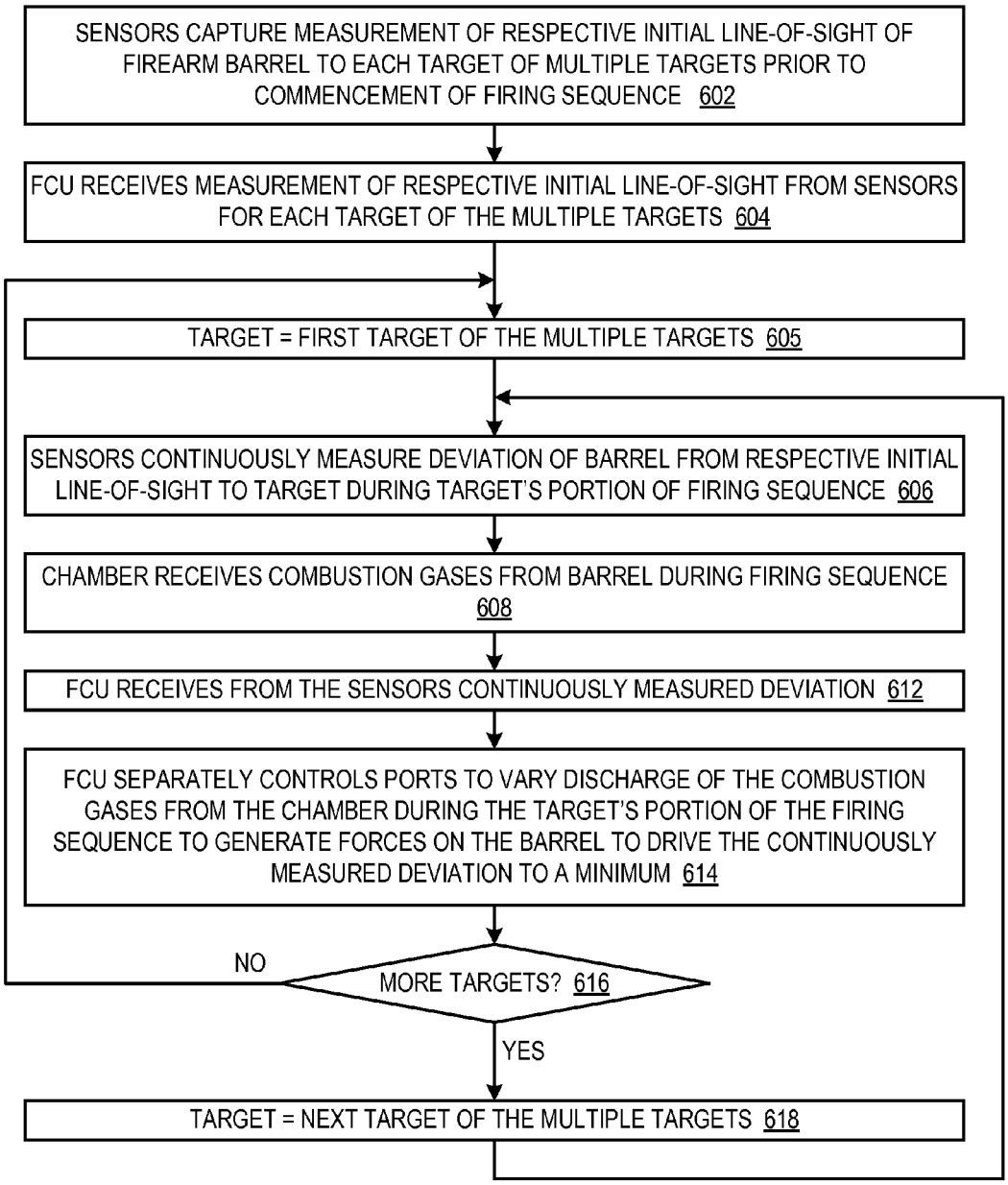

Referring now to FIG. 6, a flowchart illustrating operation of a feedback-controlled re-targeting apparatus, such as the apparatus 11 of FIGS. 1-4, according to an alternate embodiment is shown. The operation described in FIG. 6 is similar to the operation described in FIG. 5; however, the operation of FIG. 6 performs feedback-controlled re-targeting with respect to multiple targets. The apparatus directs the firearm to each of the multiple targets in sequential respective portions of the firing sequence. Flow begins at block 602.

At block 602, the sensors capture a measurement of an initial line-of-sight to a target prior to commencement of a firing sequence of the firearm similar to block 502 of FIG. 5. However, a respective initial line-of-sight measurement is captured for each target of the multiple targets. Flow proceeds to block 604.

At block 604, the feedback control unit receives the respective initial target line-of-sight measurement from the sensors for each of the multiple targets. Flow proceeds to block 605.

At block 605, a first of the multiple targets is designated the current target. Flow proceeds to block 606.

At block 606, the sensors continuously measure deviation of the barrel from the respective initial line-of-sight to the current target during the current target's respective portion of the firing sequence. Flow proceeds to block 608.

At block 608, the chamber receives combustion gases during the firing sequence, which generates pressure in the chamber. Flow proceeds to block 612.

At block 612, during the current target's respective portion of the firing sequence, the feedback control unit receives from the sensors the continuously measured deviation from the respective current target's initial line-of-sight. Flow proceeds to block 614.

At block 614, during the current target's respective portion of the firing sequence, the feedback control unit controls the ports to vary discharge of the combustion gases from the chamber to generate forces on the firearm to drive the continuously measured deviation to a minimum. Flow proceeds to decision block 616.

At block 616, the feedback control unit determines whether there are more targets of the multiple targets. That is, the feedback control unit determines whether each of the multiple targets has been fired upon according to blocks 606 through 614. In one embodiment, the feedback control unit is instructed how many rounds should be fired to each of the multiple targets before moving on to the next target. In one embodiment, the number of rounds specified may be different for each target. If there are more targets, flow proceeds to block 618; otherwise, flow proceeds to block 606 to repeat firing upon the multiple targets in a sequential fashion until the operator terminates the firing sequence. Alternatively, the feedback control unit automatically terminates the firing sequence once all targets have been fired upon.

At block 618, a next target from among the multiple targets (i.e., a target that has not yet been previously fired upon during the current sequence of procession through the multiple targets) is designated as the current target. Flow returns to block 606 to commence feedback-controlled re-targeted firing upon the new current target.

The invention claimed is:

1. An apparatus, comprising:

a body that attaches to a barrel of a firearm;

a chamber, disposed in the body, that receives combustion gases from the barrel during a firing sequence of the firearm;

sensors, mounted on the body, that capture a measurement of an initial line-of-sight to a target prior to the firing sequence and that measure deviation from the initial line-of-sight after capture of the measurement of the initial line-of-sight and during the firing sequence;

ports, in communication with the chamber, wherein the ports are controllable to vary discharge of the combustion gases from the chamber; and a feedback control unit that receives the measurement of the initial line-of-sight and the deviation from the sensors and controls the ports to vary discharge of the combustion gases from the chamber during the firing sequence to generate forces on the barrel to drive the deviation to a minimum.

2. The apparatus of claim 1, wherein the deviation measured by the sensors includes an angular deviation.

3. The apparatus of claim 2, wherein the sensors comprise fiber optic gyros.

4. The apparatus of claim 2, wherein the deviation measured by the sensors additionally includes a translational deviation.

5. The apparatus of claim 4, wherein the sensors further comprise accelerometers.

6. The apparatus of claim 1, wherein the feedback control unit calculates an error value based on the deviation, wherein the feedback control unit controls the ports to vary discharge of the combustion gases from the chamber during the firing sequence to generate forces on the barrel to drive the calculated error to a minimum.

7. The apparatus of claim 1, wherein the ports include valves actuatable to open and close the ports, wherein the feedback control unit controls opening and closing of the valves to vary discharge of the combustion gases from the chamber during the firing sequence to generate forces on the barrel to drive the deviation to a minimum.

8. The apparatus of claim 7, wherein the ports are disposed circumferentially around the chamber, wherein the feedback control unit controls the opening and closing of the valves to vary volume of discharge of the combustion gases from the chamber during the firing sequence to generate forces on the barrel to drive the deviation to a minimum.

9. The apparatus of claim 1, wherein the sensors are disposed orthogonal to one another and to the barrel to measure azimuth and elevation pointing angles.

10. The apparatus of claim 1, wherein the sensors capture a measurement of a respective initial line-of-sight to the target prior to the firing sequence, for each target of multiple targets;

wherein the feedback control unit receives from the sensors the respective initial line-of-sight to the target prior to the firing sequence, for each target of the multiple targets;

wherein the sensors measure deviation from the respective initial line-of-sight to the target during a respective portion of the firing sequence directed to the target, for each target of the multiple targets in a sequential fashion;

wherein the feedback control unit receives from the sensors the deviation from the respective initial line-of-sight during the respective portion of the firing sequence, for each target of the multiple targets in the sequential fashion; and wherein the feedback control unit controls the ports to vary discharge of the combustion gases from the chamber during the respective portion of the firing sequence to generate forces on the barrel to drive the deviation from the respective initial line-of-sight to the target to a minimum, for each target of the multiple targets in the sequential fashion.

11. A method, comprising:

capturing, by sensors mounted on an apparatus body attached to a barrel of a firearm, a measurement of an initial line-of-sight to a target prior to a firing sequence of the firearm;

receiving, by a feedback control unit of the apparatus, the measurement of the initial line-of-sight prior to the firing sequence;

measuring, by the sensors, deviation from the initial line-of-sight after said capturing the measurement of the initial line-of-sight and during the firing sequence;

receiving, by a chamber disposed in the body, combustion gases from the barrel during the firing sequence;

receiving, by the feedback control unit, the deviation from the sensors;

controlling, by the feedback control unit, ports in communication with the chamber to vary discharge of the combustion gases from the chamber during the firing sequence to generate forces on the barrel to drive the deviation to a minimum.

12. The method of claim 11, wherein the deviation measured by the sensors includes an angular deviation.

13. The method of claim 12, wherein the sensors comprise fiber optic gyros.

14. The method of claim 12, wherein the deviation measured by the sensors additionally includes a translational deviation.

15. The method of claim 14, wherein the sensors further comprise accelerometers.

16. The method of claim 11, wherein said measuring deviation from the initial line-of-sight comprises calculating an error based on the deviation, wherein said controlling the ports to vary discharge of the combustion gases from the chamber during the firing sequence to generate forces on the barrel to drive the deviation to a minimum comprises controlling the ports to vary discharge of the combustion gases from the chamber during the firing sequence to generate forces on the barrel to drive the calculated error to a minimum.

17. The method of claim 11, wherein the ports include valves actuatable to open and close the ports, wherein said controlling the ports to vary discharge of the combustion gases from the chamber during the firing sequence to generate forces on the barrel to drive the deviation to a minimum comprises controlling opening and closing of the valves to vary discharge of the combustion gases from the chamber during the firing sequence to generate forces on the barrel to drive the deviation to a minimum.

18. The method of claim 17, wherein the ports are disposed circumferentially around the chamber, wherein said controlling the ports to vary discharge of the combustion gases from the chamber during the firing sequence to generate forces on the barrel to drive the deviation to a minimum comprises the feedback controlling the opening and closing of the valves to vary volume of discharge of the combustion gases from the chamber during the firing sequence to generate forces on the barrel to drive the deviation to a minimum.

19. The method of claim 11, wherein the sensors are disposed orthogonal to one another and to the barrel to measure azimuth and elevation pointing angles.

20. A method, comprising:

capturing, by sensors mounted on an apparatus body attached to a barrel of a firearm, a measurement of a respective initial line-of-sight to a target prior to a firing sequence of the firearm for each target of multiple targets;

receiving, by a feedback control unit of the apparatus, from the sensors sensors the measurement of the respective initial line-of-sight to the target prior to the firing sequence for each target of the multiple targets;

measuring, by the sensors, deviation from the respective initial line-of-sight to the target during a respective portion of the firing sequence directed to the target for each target of the multiple targets in a sequential fashion;

receiving, by a chamber disposed in the body, combustion gases from the barrel during the firing sequence;

receiving, by the feedback control unit, from the sensors the deviation from the respective initial line-of-sight during the respective portion of the firing sequence for each target of the multiple targets in the sequential fashion; and controlling, by the feedback control unit, ports in communication with the chamber to vary discharge of the combustion gases from the chamber during the respective portion of the firing sequence to generate forces on the barrel to drive the deviation from the respective initial line-of-sight to the target to a minimum for each target of the multiple targets in the sequential fashion.

* * * * *